US011336016B2

(12) United States Patent
Ying et al.

(10) Patent No.: US 11,336,016 B2
(45) Date of Patent: May 17, 2022

(54) CAVITY SUPPORTED PATCH ANTENNA

(71) Applicant: Sony Corporation, Tokyo (JP)

(72) Inventors: Zhinong Ying, Lund (SE); Kun Zhao, Stockholm (SE)

(73) Assignee: Sony Group Corporation, Tokyo (JP)

( * ) Notice: Subject to any disclaimer, the term of this patent is extended or adjusted under 35 U.S.C. 154(b) by 78 days.

(21) Appl. No.: 16/755,776

(22) PCT Filed: Oct. 16, 2018

(86) PCT No.: PCT/EP2018/078294
§ 371 (c)(1),
(2) Date: Apr. 13, 2020

(87) PCT Pub. No.: WO2019/076928
PCT Pub. Date: Apr. 25, 2019

(65) Prior Publication Data

US 2020/0287287 A1 Sep. 10, 2020

(30) Foreign Application Priority Data

Oct. 17, 2017 (SE) ..... 1730286-0

(51) Int. Cl.
*H01Q 9/04* (2006.01)
*H01Q 1/48* (2006.01)

(52) U.S. Cl.
CPC ..... *H01Q 9/0414* (2013.01); *H01Q 1/48* (2013.01)

(58) Field of Classification Search
CPC ..... H01Q 9/0414; H01Q 9/0407; H01Q 1/48
See application file for complete search history.

(56) References Cited

U.S. PATENT DOCUMENTS 9,865,928 B2 * 1/2018 Sudo ..... H01Q 5/378
2005/0190106 A1 * 9/2005 Anguera Pros ..... H01Q 1/36 343/700 MS
2007/0080864 A1 4/2007 Channabasappa
2012/0098706 A1 4/2012 Lin et al.
(Continued)

FOREIGN PATENT DOCUMENTS

CN 104662737 A 5/2015
EP 2477275 A1 * 7/2012 ..... H01Q 1/246
(Continued)

OTHER PUBLICATIONS

Woojin Byun et al. "60GHz 2x4 Low Temperature Co-fired Ceramic Cavity Backed Array Antenna", Advanced Radio Technology Department, Electronics and Telecommunications Research Institute, 2009, IEEE (Year: 2009).*
(Continued)

*Primary Examiner* — Daniel D Chang
(74) *Attorney, Agent, or Firm* — Tucker Ellis LLP

(57) ABSTRACT

An antenna (100) comprises a cavity (120) formed by a conductive plate (121) in a first horizontal conductive layer (221) of a multi-layer circuit board and a vertical sidewall formed by conductive vias (222) extending from the conductive plate (121). Further, the antenna (100) comprises an antenna patch (130) arranged in the cavity. The antenna patch (130) is formed in a second conductive layer (223) of the multi-layer circuit board and is peripherally surrounded by the vertical sidewall of the cavity (120).

12 Claims, 8 Drawing Sheets

(56) References Cited

U.S. PATENT DOCUMENTS

| | | | |
|---|---|---|---|
| 2015/0194730 | A1 | 7/2015 | Sudo et al. |
| 2015/0263437 | A1 | 9/2015 | Yagi et al. |
| 2015/0318618 | A1 | 11/2015 | Chen et al. |
| 2016/0261039 | A1 | 9/2016 | Parsche |
| 2016/0276751 | A1 | 9/2016 | Ueda |
| 2017/0237171 | A1 | 8/2017 | Kim et al. |

FOREIGN PATENT DOCUMENTS

| | | | |
|---|---|---|---|
| EP | 2477275 | A1 | 7/2012 |
| JP | H07245521 | A | 9/1995 |
| JP | H09307338 | A | 11/1997 |
| JP | 2004274259 | A | 9/2004 |
| JP | 2012070237 | A | 4/2012 |
| JP | 2015177288 | A | 10/2015 |
| WO | 201404596 | A1 | 1/2014 |
| WO | 2014045966 | A1 | 8/2016 |
| WO | 2015083457 | A1 | 3/2017 |

OTHER PUBLICATIONS

International Search Report and Written Opinion from corresponding International Application No. PCT/EP2018/078294, dated Jan. 23, 2019, 12 pages.

Woojin Byun et al: "60GHz 2X4 low temperature co-fired ceramic cavity backed array Antenna", 2009 IEEE Antennas and Propagation Society International Symposium; Jun. 1, 2009, pp. 1-4.

Swedish Search Report from corresponding Swedish Application No. 1730286-0, dated May 22, 2018, 2 pages.

Woojin Byun et al.: "60GHz 2x4 Low Temperature Co-fired Ceramic Cavity Backed Array Antenna"; Advanced Radio Technology Department, Electronics and Telecommunications Research Institute, copyright 2009, 4 pages.

Japanese Office Action from corresponding Japanese Application No. 2020-521525, dated May 25, 2021, 4 pages.

* cited by examiner

CAVITY SUPPORTED PATCH ANTENNA

FIELD OF THE INVENTION

The present invention relates to an antenna and to a communication device equipped with such antenna.

BACKGROUND OF THE INVENTION

In wireless communication technologies, various frequency bands are utilized for conveying communication signals. In order to meet increasing bandwidth demands, also frequency bands in the millimeter wavelength range, corresponding to frequencies in the range of about 10 GHz to about 100 GHz, are considered. For example, frequency bands in the millimeter wavelength range are considered as candidates for 5G (5th Generation) cellular radio technologies. However, an issue which arises with the utilization of such high frequencies is that antenna sizes need to be sufficiently small to match the wavelength. Further, in order to achieve sufficient performance, various polarizations of radio signals may need to be supported and/or multiple antennas (e.g., in the form of an antenna array) may be needed in small sized communication devices, such as mobile phones, smartphones, or similar communication devices.

One known type of antenna which can be implemented with a compact design and may also support different polarizations is a patch antenna. However, patch antennas typically have a rather small bandwidth. Moreover, in the case of a patch antenna formed on a substrate, there may be considerable leakage of signals into the substrate, which may distort the radiation pattern of the patch antenna.

Accordingly, there is a need for compact size antennas which offer good bandwidth.

SUMMARY OF THE INVENTION

According to an embodiment, an antenna is provided. The antenna comprises a cavity formed by a conductive plate in a first horizontal conductive layer of a multi-layer circuit board and a vertical sidewall formed by conductive vias extending from the conductive plate. Further, the antenna comprises an antenna patch arranged in the cavity. The antenna patch is formed in a second conductive layer of the multi-layer circuit board and is peripherally surrounded by the vertical sidewall of the cavity. The cavity allows for avoiding that a radiation pattern of the antenna is distorted by leakage of signals into a substrate material of the circuit board. Further, a cavity mode may be excited close to a resonant frequency of the antenna patch, which allows for enhancing the bandwidth of the antenna and/or for multi-band operation of the antenna.

According to an embodiment, the conductive vias extend from the conductive plate to a third horizontal conductive layer of the multi-layer circuit board. In this case, the third horizontal conductive layer may be used to conductively couple at least some of the conductive vias. In this way, performance of the cavity may be further improved. For example, the cavity may comprise a conductive frame which is formed in the third horizontal conductive layer and conductively connects the conductive vias of the vertical sidewall. In this case, the conductive vias may be on one end conductively coupled by the conductive plate, and on another end conductively coupled by the conductive frame.

According to an embodiment, the antenna may further comprise a parasitic patch arranged in a plane which is parallel to the antenna patch and is offset from the antenna patch. Specifically, the parasitic patch may be offset from the antenna patch towards the third horizontal conductive layer. For example, the parasitic patch may be formed in the third horizontal conductive layer. The parasitic patch allows for further enhancing the bandwidth of the antenna by introducing one or more additional resonant modes close to the resonant frequency of the antenna patch. For example, in combination with the above-mentioned conductive frame the parasitic may form a ring slot which causes excitation of a ring-slot mode.

According to an embodiment, the parasitic patch is horizontally centered with respect to the antenna patch. This may allow for achieving a substantially symmetric radiation pattern of the antenna. However, in some embodiments the parasitic patch may also be horizontally offset with respect to the antenna patch, i.e., not horizontally centered. This may be used to compensate effects of other asymmetries, e.g., an asymmetric or non-centric arrangement of a feed point on the antenna patch.

According to an embodiment, the parasitic patch has a different shape than the antenna patch. This may allow for tuning the radiation pattern of the antenna. Further, the shape of the parasitic patch may also be used to compensate effects of asymmetries of the antenna patch, e.g., an asymmetric or non-centric arrangement of a feed point on the antenna patch.

According to an embodiment, the antenna comprises at least one feed connection which extends through the conductive plate to a feed point on the antenna patch. In this way, the antenna patch may be fed in an efficient manner. Specifically, the arrangement of the feed connection to extend through the conductive plate allows for a compact structure of the feed connection. This may in turn allow for avoiding signal losses and signal leakage to surrounding substrate material.

According to an embodiment, the antenna comprises a first feed connection extending through the conductive plate to a first feed point on the antenna patch and a second feed connection extending through the conductive plate to a second feed point on the antenna patch. In this way, the antenna may support multiple polarizations using the first and second feed point for feeding of signals corresponding to different polarizations. In this case, the first feed point may be offset from a center of the antenna patch in a first horizontal direction corresponding to a first polarization direction of the antenna, and the second feed point may be offset from a center of the antenna patch in a second horizontal direction corresponding to a second polarization direction of the antenna. Accordingly, transmission of dual-horizontal polarization signals may be efficiently supported in the antenna.

According to an embodiment, the antenna comprises multiple cavities, each formed by a conductive plate in the first horizontal conductive layer of the multi-layer circuit board and a vertical sidewall formed by conductive vias extending from the conductive plate, and multiple antenna patches, each arranged in a respective one of the cavities. In this case, the multiple antenna patches are formed in the second conductive layer of the multi-layer circuit board and each peripherally surrounded by the vertical sidewall of the respective cavity. Accordingly, an array of multiple antenna patches may be efficiently formed in the same multi-layer circuit board. Here, it is noted that at least some of the cavities may share the same conductive plate. Further, also the cavities may also share parts of the vertical sidewalls.

According to an embodiment, the antenna is configured for transmission of radio signals having a wavelength of more than 1 mm and less than 3 cm, corresponding to frequencies of the radio signals in the range of 10 GHz to 300 GHz.

According to a further embodiment, a communication device is provided, e.g., in the form of a mobile phone, smartphone or similar user device. The communication device comprises at least one antenna according to any one of the above embodiments. Further, the communication device comprises at least one processor configured to process communication signals transmitted via the at least one antenna. The communication device may also comprise radio front and circuitry arranged on the multi-layer circuit board of the antenna.

The above and further embodiments of the invention will now be described in more detail with reference to the accompanying drawings.

DETAILED DESCRIPTION OF EMBODIMENTS

In the following, exemplary embodiments of the invention will be described in more detail. It has to be understood that the following description is given only for the purpose of illustrating the principles of the invention and is not to be taken in a limiting sense. Rather, the scope of the invention is defined only by the appended claims and is not intended to be limited by the exemplary embodiments described hereinafter.

The illustrated embodiments relate to antennas for transmission of radio signals, in particular of short wavelength radio signals in the cm/mm wavelength range. The illustrated antennas and antenna devices may for example be utilized in communication devices, such as a mobile phone, smartphone, tablet computer, or the like.

In the illustrated concepts, a multi-layer circuit board is utilized for forming a patch antenna. The multi-layer circuit board has multiple layers stacked in a vertical direction. The layers of the multi-layer circuit board may be individually structured with patterns of conductive areas. Further, conductive strips or areas formed on different layers of the multi-layer circuit board may be connected to each other by conductive vias extending between the conductive areas of different layers to form a three-dimensional conductive structure, in the illustrated concepts one or more conductive cavities.

In the embodiments as further detailed below, it will be assumed that the multi-layer circuit board is a printed circuit board (PCB), based on structured metal layers printed on resin and fiber based substrate layers. However, it is noted that other multi-layer circuit packaging technologies could be used as well for forming the multi-layer circuit board, such as LTCC (Low Temperature Co-Fired Ceramic).

Figure 1:
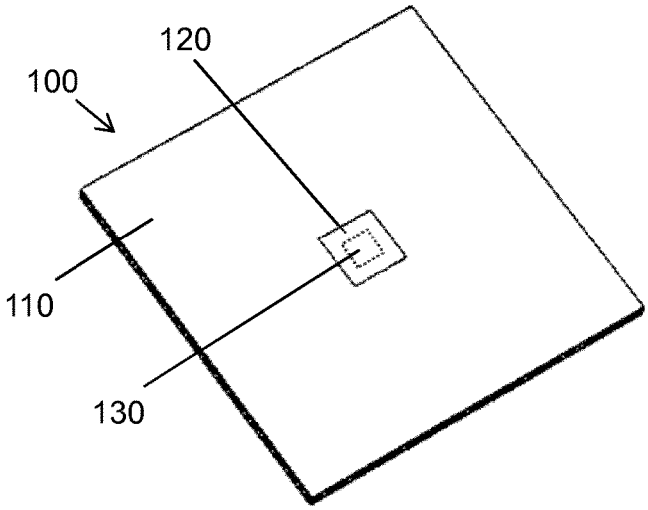
FIG. 1 shows a perspective view schematically illustrating an antenna according to an embodiment of the invention.

FIG. 1 shows a perspective view illustrating an antenna 100 which is based on the illustrated concepts. In the illustrated example, the antenna 100 includes a multi-layer PCB 110 and a cavity 120 formed in the multi-layer PCB 110. The multi-layer PCB 110 includes multiple horizontal PCB layers which are stacked in a vertical direction. The PCB layers may for example each correspond to a structured metallization layer on an isolating substrate. As illustrated by a dotted box, an antenna patch 130 is arranged within the cavity.

Figure 2:
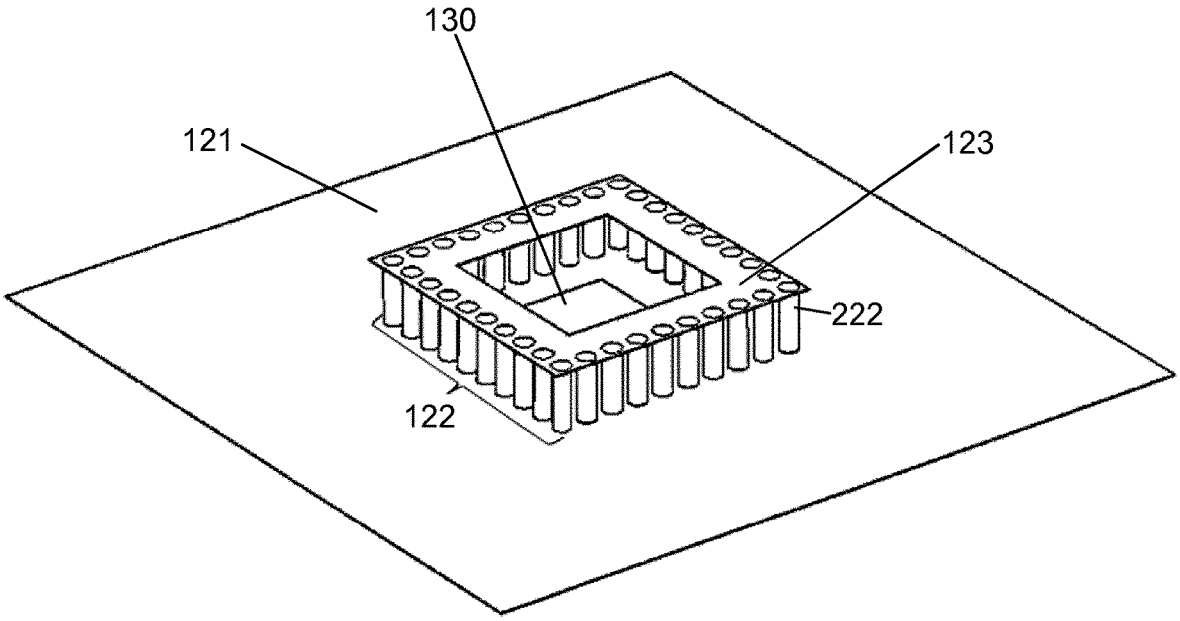
FIG. 2 shows a perspective view for illustrating structures of the antenna.

FIG. 2 shows a perspective view for further illustrating structures of the antenna 100. In FIG. 2, non-conductive substrate material of the PCB is not shown for the sake of illustration. However, it is noted that the illustrated conductive structures are supported on or embedded within non-conductive substrate material of the PCB. As illustrated in FIG. 2, the cavity 120 is formed by a conductive plate 121 and a conductive vertical sidewall 122 extending from the conductive plate 121. The vertical sidewall peripherally surrounds the antenna patch 130 in the cavity 120.

The conductive plate 121 is formed in a conductive layer of the PCB layers. The vertical sidewall 122 is formed by conductive vias 222 extending from the conductive plate 121 to a conductive frame 123 formed in another conductive layer of the PCB layers. Accordingly, on one of their ends the conductive vias 222 are conductively coupled by the conductive plate 121, while on the other of their ends the conductive vias 222 are conductively coupled by the conductive frame 123. The conductive frame 123 defines an aperture of the cavity 120. In the illustrated example, the conductive vias 222 are arranged next to each other, with a spacing between neighboring conductive vias 222 being smaller than typical wavelengths of signals to be transmitted by the antenna 100. For these signals, the vertical sidewall thus acts like a contiguous conductive surface. However, it is noted that it would also be possible to place neighboring conductive vias adjacent to each other, so that there is conductive contact on a contact surface formed between the neighboring conductive vias 222.

It is noted that while FIG. 2 illustrates the cavity 120 as having a rectangular box geometry, other geometries of the cavity 120 could be utilized as well. For example, the cavity 120 could have a non-rectangular box geometry. Further, the vertical sidewall 122 could extend along a circular, elliptic, triangular, hexagonal, or octagonal contour on the conductive plate 121, resulting in a cylinder-like or prism-like geometry of the cavity 120. Further, it is noted that while the cavity 120 could also be formed without the conductive frame 123, the presence of the conductive frame 123 allows for achieving a more precise definition of the geometry of the cavity 120 and also for obtaining a well-defined aperture of the cavity 120. Further, while FIGS. 1 and 2 illustrate the antenna patch as having a rectangular, substantially square-shaped geometry, other shapes of the antenna patch could be utilized as well, e.g., a trapezoidal shape, a circular shape, an elliptical shape, a triangular shape, a hexagonal shape, an octagonal shape, or the like. Further, also more complex shapes are possible, e.g., a ring shape, a cross shape, or various combinations of the above-mentioned shapes.

Figure 3:
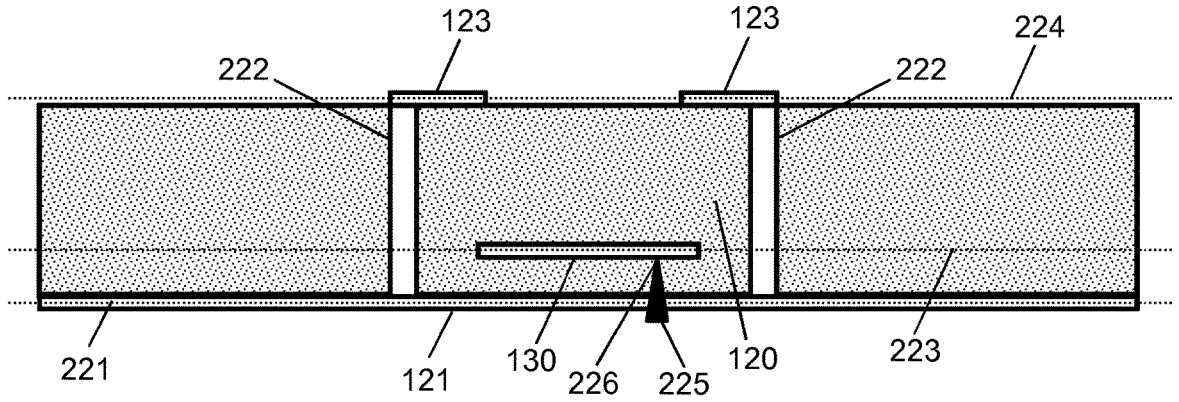
FIG. 3 shows a sectional view for illustrating structures of the antenna.

FIG. 3 shows a sectional view for further illustrating the structures of the antenna 100. In FIG. 3, the position of conductive PCB layers is illustrated by horizontal dotted lines. In particular, FIG. 3 illustrates the position of a first conductive PCB layer 221, a second conductive PCB layer 223, and a third conductive PCB layer 224. The conductive plate 121 is formed in the first conductive PCB layer 221. The antenna patch 130 is formed in the second conductive PCB layer 223. The conductive frame 123 is formed in the third conductive PCB layer 224. The conductive vias 222 forming the vertical sidewall 122 extend between the first conductive PCB layer 221 and the third conductive PCB layer 224. As further illustrated, the antenna patch 130 is embedded within non-conductive substrate material of the PCB 110.

As further illustrated, a feed connection 225 of the antenna 100 extends through the conductive plate 121 to a feed point 226 on the antenna patch 130. The feed connection 225 may be formed by a conductive via which is electrically isolated from the conductive plate 121. As illustrated, the feed point 226 is horizontally offset from a center of the antenna patch 130, which facilitates transmission of signals with a horizontal linear polarization direction.

In FIGS. 2 and 3, the conductive plate 121 is illustrated as forming a bottom of the cavity 120 and as having an outside portion extending on the outside of the cavity 120. The latter portion of the conductive plate 121 may be used for tuning a frequency of a resonant mode excited in the cavity 120. However, it is noted that in modified examples at least a part of the outside portion of the conductive plate 121 could be omitted. Accordingly, at least a part of the vertical sidewall 122 could be aligned with an outer boundary of the conductive plate 121.

Figure 4:
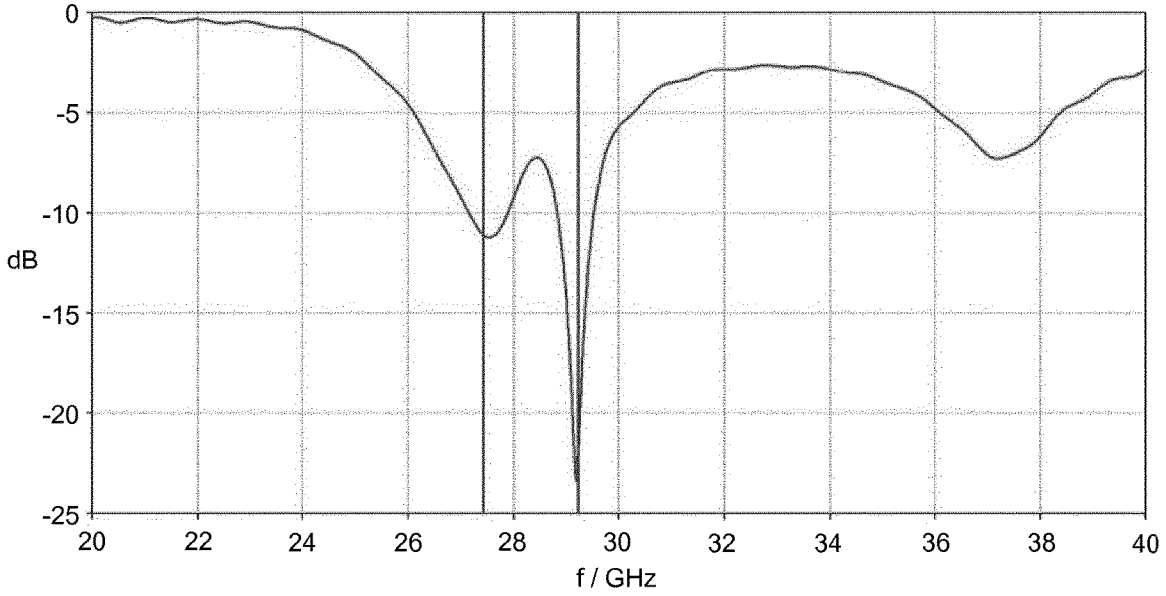
FIG. 4 shows a diagram for illustrating a frequency characteristic of the antenna of FIGS. 1 to 3.

FIG. 4 shows simulation based exemplary frequency characteristics for illustrating the effect of the cavity 120 of the antenna 100. As can be seen, the antenna 100 exhibits a first resonant frequency at about 29 GHz, corresponding to a resonant mode of the cavity 120, and a second resonant frequency at about 27 GHz, corresponding to a resonant mode of the antenna patch 130. These frequencies are well matched with frequency bands of the millimeter wavelength range considered as candidates for 5G technologies. Accordingly, the antenna 100 could be used as a dual-band antenna covering a first frequency band at about 27 GHz and a second frequency band at about 29 GHz. However, it is noted that by modifying the geometry of the antenna patch 130 and/or of the cavity 120, the resonant frequencies could be shifted closer to each other, thereby obtaining a single wide resonant frequency range of several GHz. In the latter case, the antenna 100 could be used as a wideband antenna supporting multiple frequency bands.

Figure 5A:
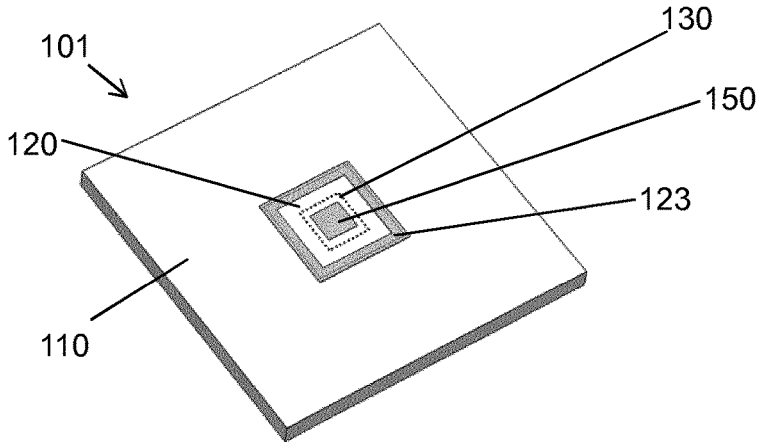
FIG. 5A shows a perspective view schematically illustrating an antenna according to a further embodiment of the invention.

FIG. 5A shows an antenna 101 according to a further embodiment. The antenna 101 is generally similar to the antenna 100, and structures of the antenna 101 which correspond to those of the antenna 100 have been designated by the same reference numerals. Further details concerning these structures can be taken from the corresponding description in connection with FIGS. 1 to 3. As can be seen, also the antenna 101 includes a multi-layer PCB 110 and a cavity 120 formed in the multi-layer PCB 110. The multi-layer PCB 110 includes multiple horizontal PCB layers which are stacked in a vertical direction. The PCB layers may for example each correspond to a structured metallization layer on an isolating substrate. As illustrated by a dotted box, an antenna patch 130 is arranged within the cavity.

Figure 5B:
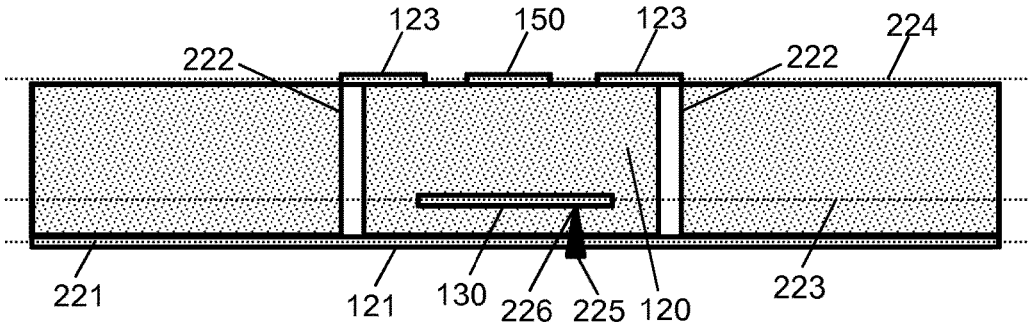
FIG. 5B shows a sectional view for illustrating structures of the antenna of FIG. 5A.

FIG. 5B shows a sectional view for further illustrating structures of the antenna 101. As can be seen, also in the antenna 101, the cavity 120 is formed by a conductive plate 121 and a conductive vertical sidewall 122 extending from the conductive plate 121. The vertical sidewall peripherally surrounds the antenna patch 130 in the cavity 120. Further, the antenna 101 includes a parasitic patch 150 arranged in a plane which is parallel to the antenna patch 130 and offset from the antenna patch 130. The parasitic patch 150 is floating, i.e., not conductively coupled to the antenna patch 130 or to the cavity 120. Excitation of the parasitic patch 150 may occur by capacitive coupling to the antenna patch 130 and/or to the cavity 120.

As further illustrated by the sectional view of FIG. 5B, also in the antenna 101 the conductive plate 121 is formed in a conductive layer of the PCB layers. The vertical sidewall 122 is formed by conductive vias 222 extending from the conductive plate 121 to a conductive frame 123 formed in another conductive layer of the PCB layers. Accordingly, on one of their ends the conductive vias 222 are conductively coupled by the conductive plate 121, while on the other of their ends the conductive vias 222 are conductively coupled by the conductive frame 123. The conductive frame 123 defines an aperture of the cavity 120. In the example of FIGS. 5A and 5B, the parasitic patch 150 is arranged in the same plane as the conductive frame 123. Specifically, the parasitic patch 150 is arranged in the aperture of the cavity 120 as defined by the conductive frame 123. Together with the conductive frame 123 the parasitic patch 150 forms a ring-slot aperture of the cavity 120.

In FIG. 5B, the position of conductive PCB layers is illustrated by horizontal dotted lines. In particular, FIG. 5B illustrates the position of a first conductive PCB layer 221, a second conductive PCB layer 223, and a third conductive PCB layer 224. The conductive plate 121 is formed in the first conductive PCB layer 221. The antenna patch 130 is formed in the second conductive PCB layer 223. The conductive frame 123 and the parasitic patch 150 are formed in the third conductive PCB layer 224. The conductive vias 222 forming the vertical sidewall 122 extend between the first conductive PCB layer 221 and the third conductive PCB layer 224. As further illustrated, the antenna patch 130 is embedded within non-conductive substrate material of the PCB 110.

Also in the antenna 101 a feed connection 225 of the antenna 100 extends through the conductive plate 121 to a feed point 226 on the antenna patch 130. The feed connection 225 may be formed by a conductive via which is electrically isolated from the conductive plate 121. As illustrated, the feed point 226 is horizontally offset from a center of the antenna patch 130, which facilitates transmission of signals with a horizontal linear polarization direction.

Like explained above for the antenna 100, also in the antenna 101 the cavity 120 may have a rectangular box geometry, but other geometries of the cavity 120 could be utilized as well, e.g., a cylinder-like or prism-like geometry of the cavity 120. Further, the antenna patch 130 and the parasitic patch 150 could have different sizes and shapes. For example, the parasitic patch 150 could cover a larger area than the antenna patch 130. Further, the parasitic patch 150 could have a circular shape while the antenna patch 150 has a rectangular shape.

Figure 6:
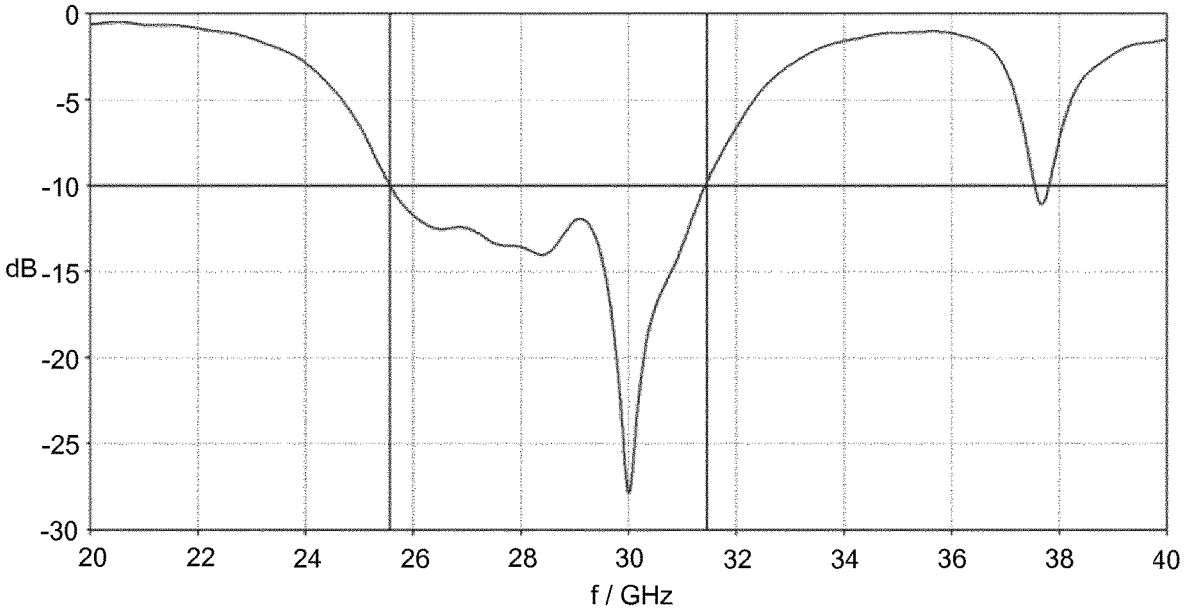
FIG. 6 shows a diagram for illustrating a frequency characteristic of the antenna of FIGS. 5A and 5B.

FIG. 6 shows simulation based exemplary frequency characteristics for illustrating the effect of the cavity 120 and the parasitic patch 150 of the antenna 101. As can be seen, the antenna 101 exhibits a resonance peak at about 30 GHz, corresponding to a resonant mode of the cavity 120, and a shoulder extending from this peak to lower frequencies. The shoulder is formed by a resonant peak corresponding to a resonant mode of the antenna patch 120, at about 26.5 GHz, and a resonant peak corresponding to a resonant mode of the ring-slot aperture formed by the conductive frame 123 and the parasitic patch 150. In combination, a resonant frequency range extends from about 25 GHz to 32 GHz. This frequency range covers various frequency bands of the millimeter wavelength range which are considered as candidates for 5G technologies. Accordingly, the antenna 100 could be used as a wideband antenna covering multiple frequency bands in the range from 25 GHz to 32 GHz.

The due to their generally symmetric structure within the horizontal plane above-mentioned antennas 100 and 101 can be modified for dual-polarization operation by including an additional feed point on the antenna patch 130. A corresponding example of an antenna 102 is illustrated in FIG. 7.

The antenna 102 is generally similar to the antenna 101, and structures of the antenna 101 which correspond to those of the antenna 101 have been designated by the same reference numerals. Further details concerning these structures can be taken from the corresponding description in connection with FIGS. 5A and 5B. As can be seen, also the antenna 101 includes a multi-layer PCB 110 and a cavity 120 formed in the multi-layer PCB 110. The multi-layer PCB 110 includes multiple horizontal PCB layers which are stacked in a vertical direction. The PCB layers may for example each correspond to a structured metallization layer on an isolating substrate. As illustrated by a dotted box, an antenna patch 130 is arranged within the cavity. Further, the antenna 102 includes a parasitic patch 150 arranged in a plane which is parallel to the antenna patch 130 and offset from the antenna patch 130.

Figure 7:
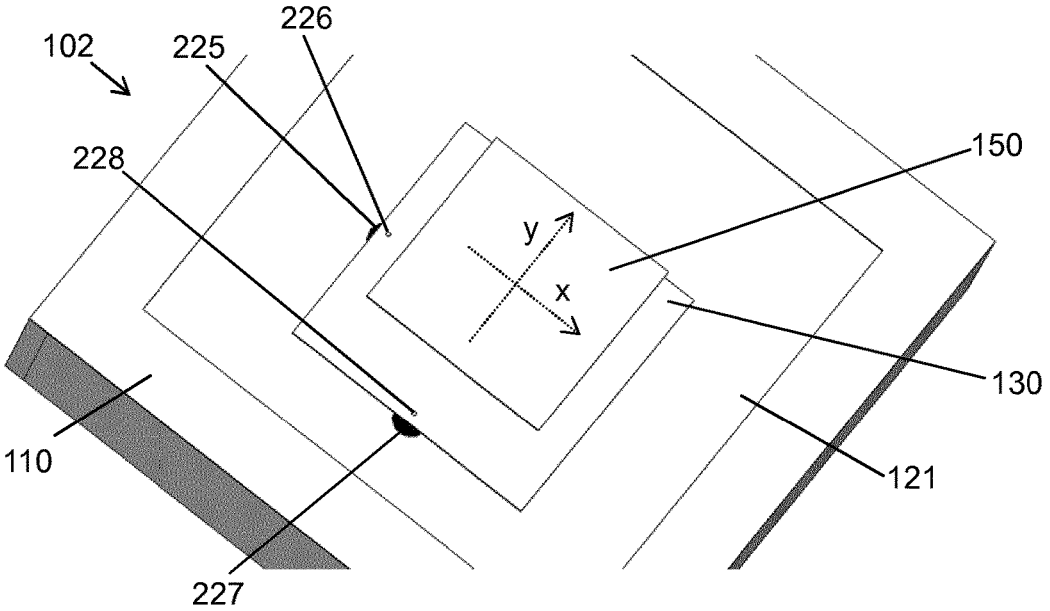
FIG. 7 shows a perspective view schematically illustrating an antenna according to a further embodiment of the invention.

As illustrated in FIG. 7, the antenna 102 has multiple feed connections, in particular a first feed connection 225 a first feed point 226 on the antenna patch 130 and a second feed connection 227 a second feed point 228 on the antenna patch 130 Like explained above, the feed connections 225, 227 extend through the conductive plate 121 of the cavity 120 and may be formed by a conductive via which is electrically isolated from the conductive plate 121. As illustrated, the first feed point 226 is offset from a center of the antenna patch 130 in a first horizontal direction, referred to as "x", and the second feed point 228 is offset from the center of the antenna patch 130 in a second horizontal direction, referred to as "y", which is perpendicular to the x-direction. In this way, the antenna 102 can be utilized for transmission of signals polarized in the x-direction and for transmission of signals polarized in the y-direction.

Figure 8:
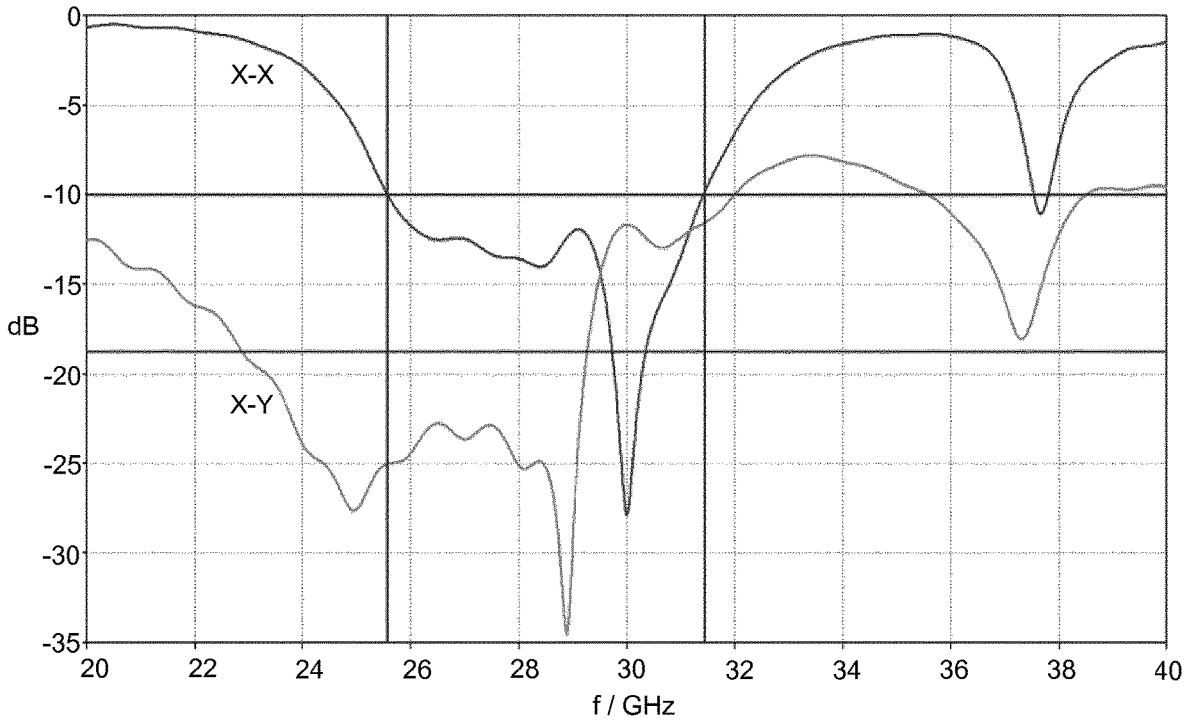
FIG. 8 shows a diagram for illustrating a frequency characteristic of the antenna of FIG. 7.

FIG. 8 shows simulation based exemplary frequency characteristics for illustrating the dual-polarization properties of the antenna 102. In FIG. 8, a curve denoted by X-X denotes a signal magnitude of signals polarized in the x-direction. A curve denoted by X-Y denotes a signal magnitude of cross coupling between signals polarized in the x-direction and signals polarized in the y-direction. As can be seen, cross coupling is generally low. However, at frequencies around 30 GHz stronger cross coupling is observed. This stronger cross coupling can be attributed to an asymmetric deformation of the radiation pattern of the antenna 102 at frequencies corresponding to the resonant mode of the cavity 120.

In the antenna 102, but also in the antenna 101, it can be observed from simulations that at frequencies around 30 GHz, corresponding to the resonant mode of the cavity 120, the radiation pattern of the antenna becomes asymmetric and leans to one side away from the vertical direction. This can be attributed to the above-mentioned arrangement of the feed points 226, 228, which are offset from the center of the antenna patch 130. To reduce or avoid this effect, the parasitic patch 150 may be horizontally offset with respect to the antenna patch 130. An example of an antenna 103, which corresponds to such a modification of the antenna 102, is illustrated in FIG. 9.

Figure 9:
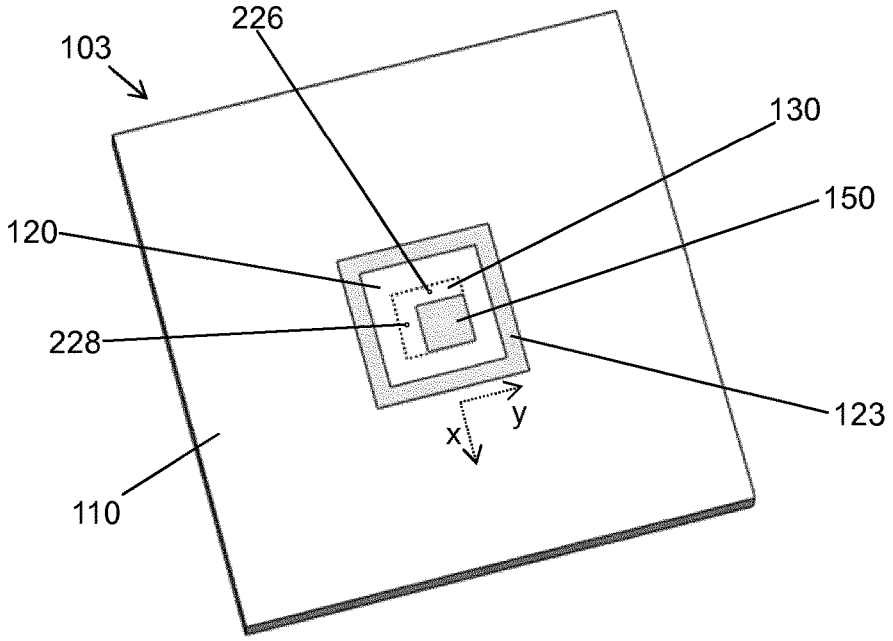
FIG. 9 shows a perspective view schematically illustrating an antenna according to a further embodiment of the invention.

As can be seen from FIG. 9, in the antenna 103 the parasitic patch 150 is horizontally offset with respect to the antenna patch 130. Specifically, in the x-direction the parasitic patch 150 is offset away from the first feed point 226, and in the y-direction the parasitic patch 150 is offset away from the second feed point 228.

Figure 10:
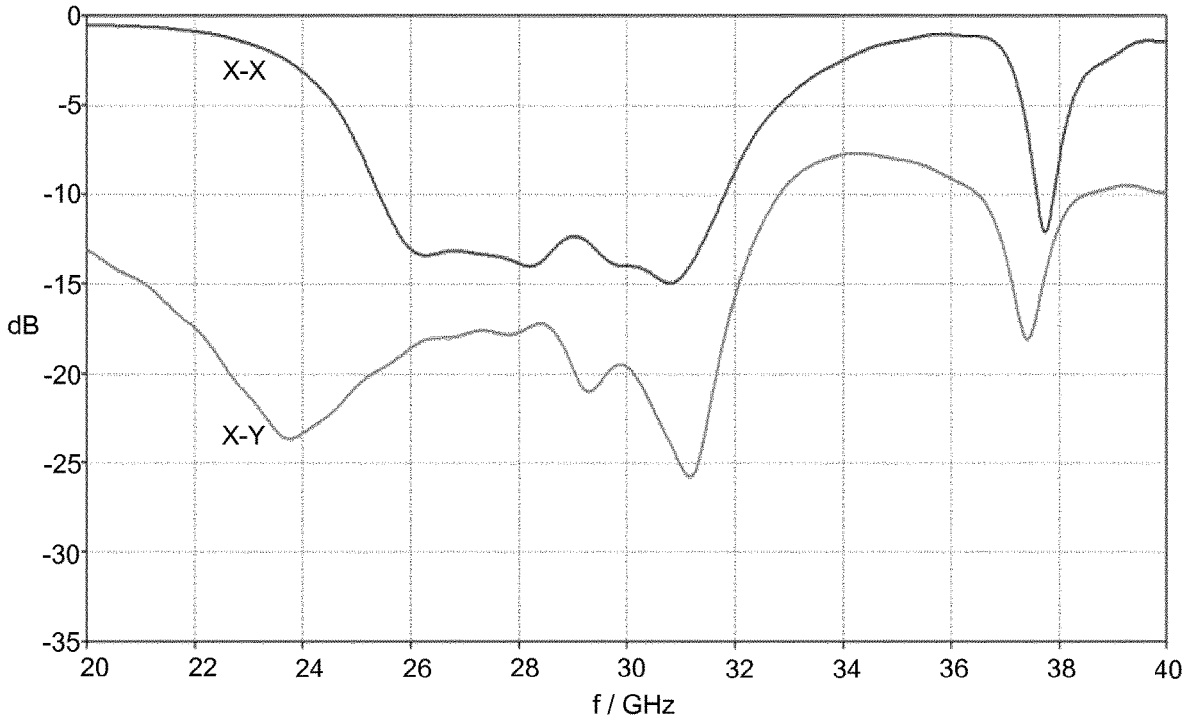
FIG. 10 shows a diagram for illustrating a frequency characteristic of the antenna of FIG. 9.

FIG. 10 shows simulation based exemplary frequency characteristics for illustrating the dual-polarization properties of the antenna 103. In FIG. 10, a curve denoted by X-X denotes a signal magnitude of signals polarized in the x-direction. A curve denoted by X-Y denotes a signal magnitude of cross coupling between signals polarized in the x-direction and signals polarized in the y-direction. As can be seen from a comparison to FIG. 8, cross coupling in the range of 30 GHz is significantly reduced as compared to the antenna 102.

It is noted that the offsetting of the parasitic patch 150 like explained for the antenna 103 could also be used for single-polarization antennas like the above-mentioned antenna 101. In this case, the offsetting of the parasitic patch 150 can be used to maintain symmetry of the radiation pattern.

Figure 11A:
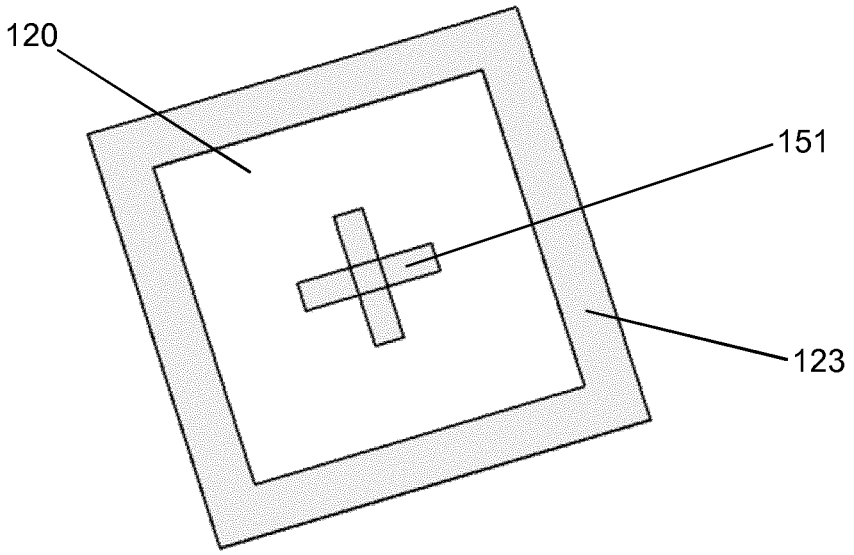
FIGS. 11A and 11B show perspective views for illustrating various shapes of parasitic antenna patches which may be used in antenna according to a further embodiment of the invention.
Figure 11B:
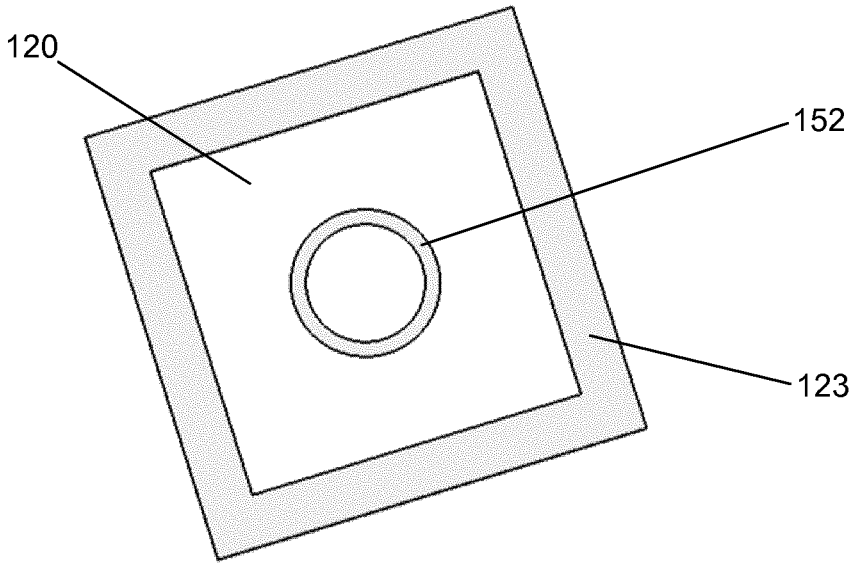

While in the above examples the parasitic patch 150 was illustrated as having a rectangular shape, other shapes of the parasitic patch 150 could be used as well. Examples of such other shapes are illustrated in FIG. 11A and FIG. 11B. In the example of FIG. 11A, a parasitic patch 151 has a cross-like shape. In the case of a dual-polarization antenna, e.g., like the above-mentioned antennas 101, 103, the branches of the cross formed by the parasitic patch 151 may be aligned with the two polarization directions of the antenna. The cross-like shape of the parasitic patch 150 may then help to further reduce cross coupling effects between the two polarization directions. In the example of FIG. 11B, a parasitic patch 152 has a ring-like shape. In the case of a dual-polarization antenna, e.g., like the above-mentioned antennas 101, 103, also the ring-like shape of the parasitic patch 150 may then help to further reduce cross coupling effects between the two polarization directions. Further, the shapes of the parasitic patches 151, 152 may also be used for tuning the radiation pattern of the antenna.

It is noted that the shapes of the parasitic purchase 151, 152 are merely exemplary and that other shapes could be used as well, e.g., circular or elliptical shapes. Further, it is noted that also the parasitic patches 151, 152 could be horizontally offset like explained in connection with the antenna 103. The parasitic patches 151, 152 may be used as a replacement of the parasitic patch 150 in any of the above-mentioned antennas 101, 102, 103.

Figure 12:
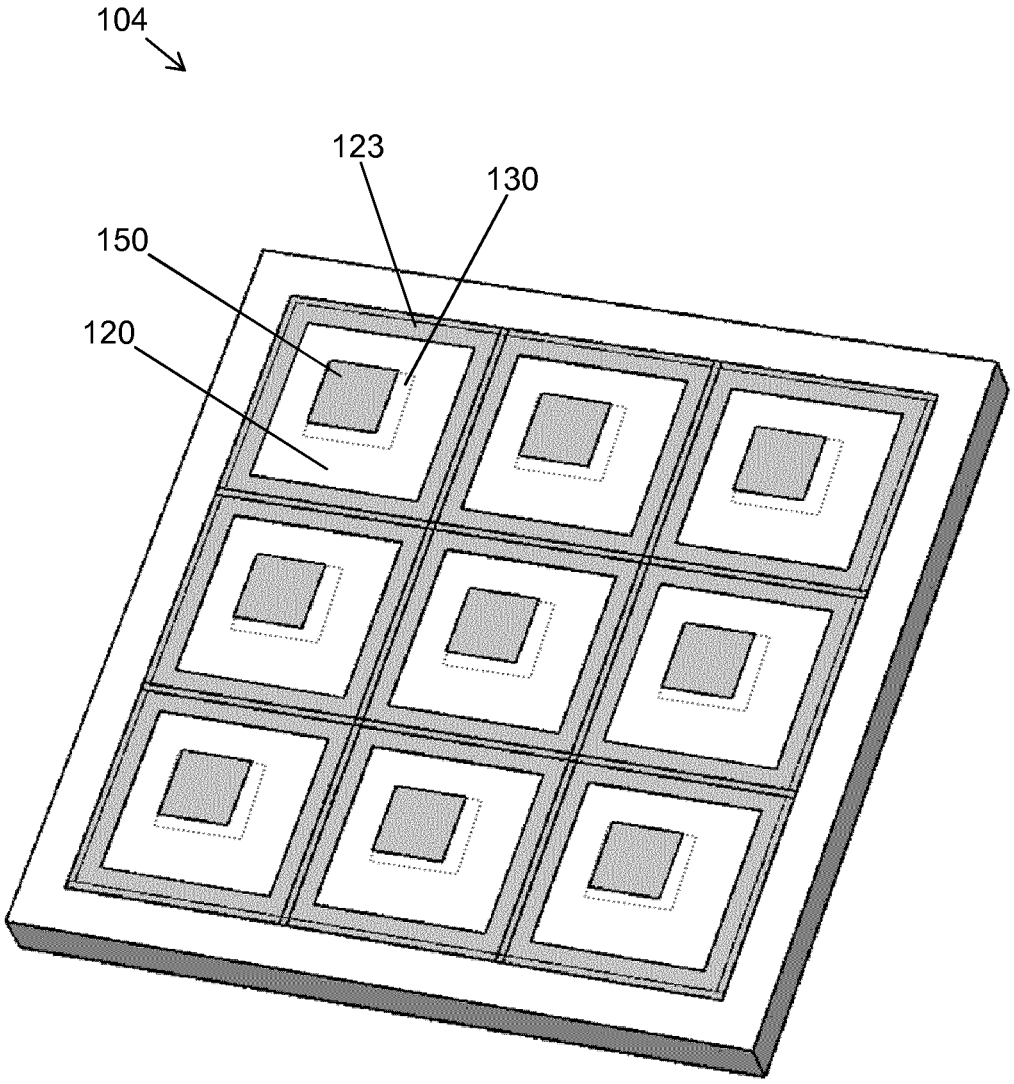
FIG. 12 shows a perspective view schematically illustrating an array antenna according to a further embodiment of the invention.

FIG. 12 illustrates a further example of an antenna 104. The antenna 104 is configured as an array antenna and includes multiple antenna patches 130. Each of the multiple antenna patches 130 is arranged in a corresponding cavity 120 formed in a PCB 110. For each of the multiple antenna patches 130, the arrangement and detailed structures may be as explained above in connection with FIGS. 1-3 and, 5A, 5B, 7, 9, 11A, and 11B. Like for example illustrated in FIG. 12, a corresponding parasitic patch 150 could be provided for each of the multiple antenna patches 130. Further, such parasitic patches 150 could be horizontally offset with respect to the corresponding antenna patch 130, like explained for the antenna 103. Further, the antenna patches 130 could each be used for dual-polarized operation, like explained for the antennas 102 and 103. Further, various shapes of the parasitic patches 150 could be used, e.g., shapes like explained in connection with FIGS. 11A and 11B.

As further illustrated in FIG. 12, at least some of the multiple cavities 120 formed in the PCB 110 of the antenna 104 may share parts of their vertical sidewalls. Similarly, a single conductive plate 121 could be used for forming at least some of the cavity is 120 of the antenna 104. Accordingly, the multiple cavities 120 of the antenna 104 may be formed in an efficient manner.

In the above examples, a method of manufacturing the antenna 100, 101, 102, 103, or 104 may include providing a cavity formed by a conductive plate in a first horizontal conductive layer of a multi-layer circuit board and a vertical sidewall formed by conductive vias extending from the conductive plate, such as the above-mentioned cavity 120. The conductive vias may extend from the conductive plate to a third horizontal conductive layer of the multi-layer circuit board. The method may also include providing the cavity with a conductive frame which is formed in the third horizontal conductive layer and conductively connects the conductive vias of the vertical sidewall, such as the above-mentioned conductive frame 123. Further, the method may include providing an antenna patch arranged in the cavity, such as the above-mentioned antenna patch 130. The antenna patch may be formed in a second conductive layer of the multi-layer circuit board, such that it is peripherally surrounded by the vertical sidewall of the cavity. The method may also include providing a parasitic patch arranged in a plane which is parallel to the antenna patch and is offset from the antenna patch towards the third horizontal conductive layer, such as the above-mentioned parasitic patch 150. In this case, the parasitic patch may be formed in the third horizontal conductive layer. Accordingly, the antenna 100, 101, 102, 103, or 104 may be efficiently formed by providing patterned conductive structures in the multi-layer circuit board.

Figure 13:
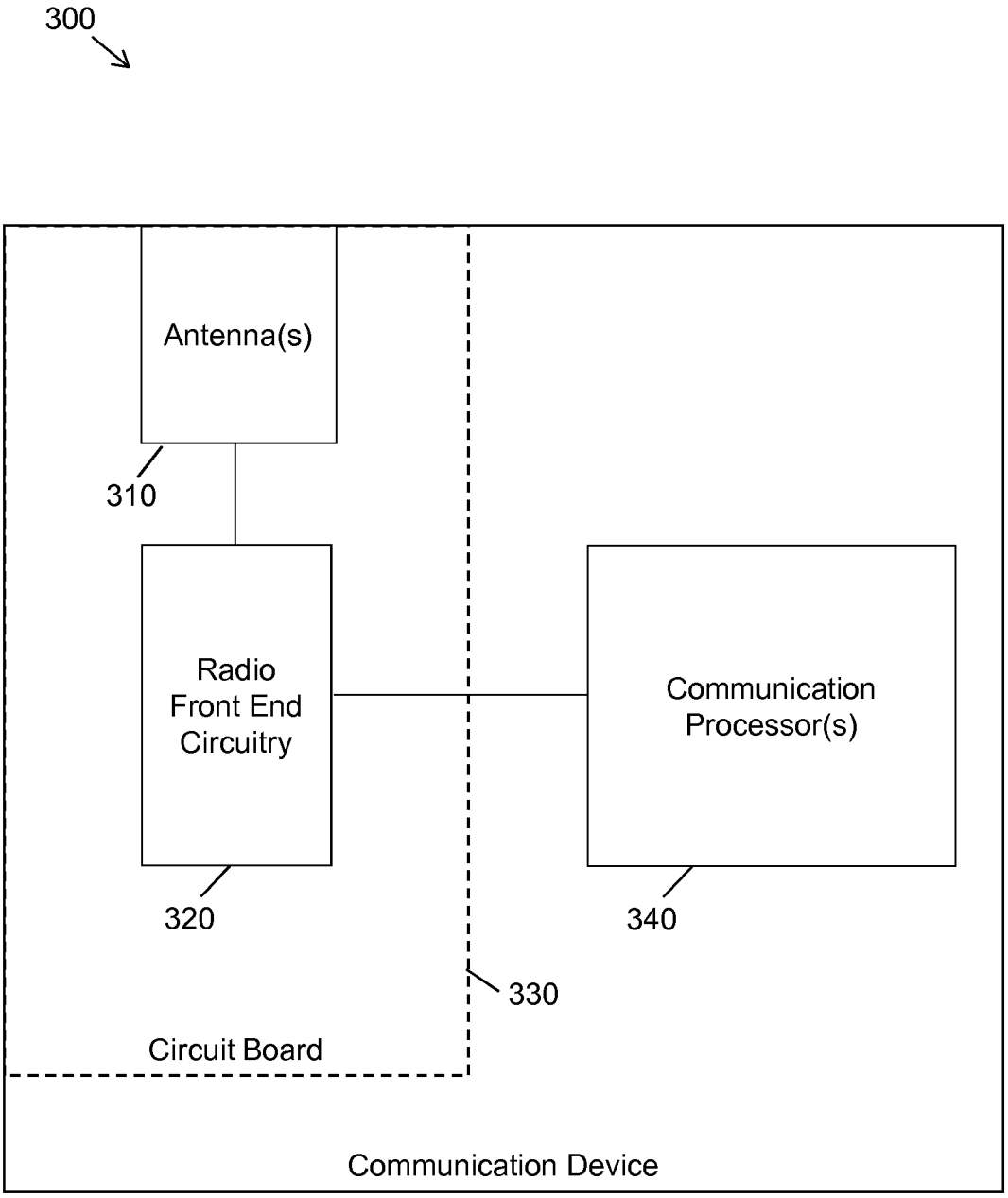
FIG. 13 shows a block diagram for schematically illustrating a communication device according to an embodiment of the invention.

FIG. 13 schematically illustrates a communication device 300 which is equipped with at least one antenna 310. The antenna(s) 310 may have structures as explained above, e.g., correspond to the antenna 100, 101, 102, 103, or 104. Further, the communication device 300 may also include other kinds of antennas. The communication device 300 may correspond to a small sized user device, e.g., a mobile phone, a smartphone, a tablet computer, or the like. However, it is to be understood that other kinds of communication devices could be used as well, e.g., vehicle based communication devices, wireless modems, or autonomous sensors.

The antenna(s) 310 may be integrated together with radio front end circuitry 320 on a multi-layer circuit board 330, such as the above-mentioned multi-layer PCB 110. As further illustrated, the communication device 300 also includes one or more communication processor(s) 340. The communication processor(s) 340 may generate or otherwise process communication signals for transmission via the antenna(s) 310. For this purpose, the communication processor(s) 340 may perform various kinds of signal processing and data processing according to one or more communication protocols, e.g., in accordance with a 5G cellular radio technology.

It is to be understood that the concepts as explained above are susceptible to various modifications. For example, the concepts could be applied in connection with various kinds of radio technologies and communication devices, without limitation to a 5G technology. Rather, the concepts are applicable in various frequency ranges and with various antenna bandwidths. The illustrated antennas may be used for transmitting radio signals from a communication device and/or for receiving radio signals in a communication device. The antennas may be produced in an efficient manner, e.g., by using various PCB technologies to provide the conductive layers, plates, and vias. Further, while in the above examples the cavity 120 was described as being filled with substrate material, it is also possible to remove the substrate material from at least a part of the cavity 120. Similarly, it would also be possible to remove substrate material surrounding the cavity. Further, it is to be understood that the illustrated antenna structures may be subjected to various modifications concerning antenna geometry. For example, the above-mentioned antenna patches and/or parasitic patches could be modified in various ways with respect to their shape, without limitation to the above-mentioned shapes, e.g., by using circular, elliptical, triangular, hexagonal, or octagonal shapes, or more complex shapes formed by combining two or more of the above-mentioned shapes. Further, the illustrated antenna structures could be subjected to various modifications concerning the feeding connection. For example, in addition to or as an alternative to the illustrated direct feeding connection extending vertically through the conductive plate, the antenna could also utilize a feeding connection which is based on probe feeding, strip line feeding, surface integrated waveguide feeding, or slot feeding.

The invention claimed is:

1. An antenna, comprising:

a cavity formed by a conductive plate in a first horizontal conductive layer of a multi-layer circuit board and a vertical sidewall formed by conductive vias extending from the conductive plate;

an antenna patch arranged in the cavity, the antenna patch being formed in a second conductive layer of the multi-layer circuit board and being peripherally surrounded by the vertical sidewall of the cavity; and a parasitic patch arranged in a plane which is parallel to the antenna patch, wherein the parasitic patch is vertically offset from the antenna patch towards a third horizontal conductive layer, is horizontally offset with respect to the antenna patch, and has a different shape than the antenna patch.

2. The antenna according to claim 1, wherein the conductive vias extend from the conductive plate to the third horizontal conductive layer of the multi-layer circuit board.

3. The antenna according to claim 2, wherein the cavity further comprises a conductive frame which is formed in the third horizontal conductive layer and conductively connects the conductive vias of the vertical sidewall.

4. The antenna according to claim 1, wherein the parasitic patch is formed in the third horizontal conductive layer.

5. The antenna according to claim 1, wherein the parasitic patch is horizontally centered with respect to the antenna patch.

6. The antenna according to claim 1, comprising:

at least one feed connection extending through the conductive plate to a feed point on the antenna patch.

7. The antenna according to claim 1, comprising:

a first feed connection extending through the conductive plate to a first feed point on the antenna patch; and a second feed connection extending through the conductive plate to a second feed point on the antenna patch.

8. The antenna according to claim 7, wherein the first feed point is offset from a center of the antenna patch in a first horizontal direction corresponding to a first polarization direction of the antenna, and wherein the second feed point is offset from a center of the antenna patch in a second horizontal direction corresponding to a second polarization direction of the antenna.

9. The antenna according to claim 1, comprising:

multiple cavities, each formed by a conductive plate in the first horizontal conductive layer of the multi-layer circuit board and a vertical sidewall formed by conductive vias extending from the conductive plate;

multiple antenna patches, each arranged in a respective one of the cavities, the antenna patches being formed in the second conductive layer of the multi-layer circuit board and being peripherally surrounded by the vertical sidewall of the respective cavity.

10. The antenna according to claim 1, wherein the antenna is configured for transmission of radio signals having a wavelength of more than 1 mm and less than 3 cm.

11. A communication device, comprising:

at least one antenna according to claim 1; and at least one processor configured to process communication signals transmitted via the at least one antenna.

12. The communication device according to claim 11, comprising:

radio front end circuitry arranged on the multi-layer circuit board.

* * * * *